US011250744B2

(12) United States Patent
Huang et al.

(10) Patent No.: US 11,250,744 B2
(45) Date of Patent: Feb. 15, 2022

(54) OPTICAL ADJUSTMENT METHOD AND OPTICAL ADJUSTMENT DEVICE FOR DISPLAY PANEL, AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Liwei Huang, Beijing (CN); Wei He, Beijing (CN); Jing Wang, Beijing (CN); Zhiyong Yang, Beijing (CN); Xueping Li, Beijing (CN); Wei Li, Beijing (CN); Shihua Huang, Beijing (CN); Xue Jiang, Beijing (CN); Xiao Luo, Beijing (CN); Wei Liu, Beijing (CN); Xiaohong Chen, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/456,960

(22) Filed: Jun. 28, 2019

(65) Prior Publication Data

US 2020/0051476 A1 Feb. 13, 2020

(30) Foreign Application Priority Data

Aug. 13, 2018 (CN) ..... 201810915499.7

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01); *G09G 2320/0242* (2013.01);
(Continued)

(58) Field of Classification Search
CPC ..... G09G 3/006; G09G 3/3225; G09G 2320/0242; G09G 2320/0626;
(Continued)

(56) References Cited

U.S. PATENT DOCUMENTS

2005/0140691 A1* 6/2005 Rice ..... G09F 5/04 345/593
2012/0081414 A1* 4/2012 Takahashi ..... G09G 3/3648 345/690

(Continued)

FOREIGN PATENT DOCUMENTS

CN 104751756 A 7/2015
CN 205333996 U 6/2016

(Continued)

OTHER PUBLICATIONS

First Office Action for Chinese Application No. 201810915499.7, dated Aug. 26, 2019, 8 Pages.

(Continued)

*Primary Examiner* — Md Saiful A Siddiqui
(74) *Attorney, Agent, or Firm* — Brooks Kushman P.C.

(57) ABSTRACT

An optical adjustment method and an optical adjustment device for a display panel, and a display device are provided. The optical adjustment method includes: displaying N groups of testing images sequentially on the display panel, each group of testing images including M images distributed at different display regions of the display panel, each image corresponding to one to-be-adjusted reference color, N being an integer greater than or equal to 1, M being an integer greater than or equal to 1; and when each group of testing (Continued)

images are displayed on the display panel, detecting, by an optical detection unit, optical parameters of the M images in the group of testing images simultaneously, and performing optical adjustment on the display panel in accordance with the optical parameters.

7 Claims, 6 Drawing Sheets

(52) U.S. Cl.
CPC ..... *G09G 2320/0626* (2013.01); *G09G 2320/0666* (2013.01); *G09G 2320/0673* (2013.01)

(58) Field of Classification Search
CPC ... G09G 2320/0666; G09G 2320/0673; G09G 2320/0693; G09G 3/3208
See application file for complete search history.

(56) References Cited

U.S. PATENT DOCUMENTS

2014/0055500 A1* 2/2014 Lai ..... G09G 3/3225 345/690
2015/0055025 A1* 2/2015 Gotoh ..... G09G 3/2007 348/790
2016/0198115 A1* 7/2016 Tsuchiya ..... H04N 5/379 348/294
2017/0116956 A1* 4/2017 Yang ..... G01N 21/95
2018/0033380 A1 2/2018 An

FOREIGN PATENT DOCUMENTS

CN 106023942 A 10/2016
CN 106297699 A 1/2017
CN 107918217 A 4/2018

OTHER PUBLICATIONS

1st Chinese Office Action, English Translation.
CN106023942A, English Abstract and U.S. Equivalent U.S. Pub. No. 2018/0033380.
CN104751756A, English Abstract and U.S. Equivalent U.S. Pub. No. 2017/0116956.
CN106297699A, English Abstract and Machine Translation.
CN107918217A, English Abstract and Machine Translation.
CN205333996U, English Abstract and Machine Translation.

* cited by examiner

OPTICAL ADJUSTMENT METHOD AND OPTICAL ADJUSTMENT DEVICE FOR DISPLAY PANEL, AND DISPLAY DEVICE

CROSS-REFERENCE TO RELATED APPLICATION

This application claims priority to Chinese Patent Application No. 201810915499.7 filed on Aug. 13, 2018, which is incorporated herein by reference in its entirety.

TECHNICAL FIELD

The present disclosure relates to the field of optical adjustment technology, in particular to an optical adjustment method and an optical adjustment method for a display panel, and a display device.

BACKGROUND

Due to a structure and a driving mode of an Organic Light-Emitting Diode (OLED) panel, it is impossible for a product in an initial state to accurately meet a mapping relationship between electric quantity (digital signal) and optical quantity (analogue signal) defined by a customer and industry standard. Hence, it is necessary to perform optical adjustment, e.g., gamma tuning, on each OLED product.

Usually, a typical serial mode is adopted by a conventional gamma tuning method for the OLED display panel. A driving Integrated Circuit (IC) is provided with n groups of registers, and each group corresponds to m grayscale binding points, i.e., it is necessary to perform a brightness and chromaticity coordinate tuning operation on n*m debugging points. When the above serial mode is adopted, it takes about 98 s for the entire tuning operation, depending on a current algorithm level, so the manufacture efficiency is adversely affected. An improved algorithm policy has been proposed, and it takes about 72 s for the entire tuning operation when n=5 and m=11. Although the time is reduced, the image quality is adversely affected to some extent. A further-improved algorithm policy has also been proposed, and it takes about 25 s for the entire tuning operation when n=1 and m=11. However, due to the lack of characteristic dynamic matching, there is a risk of Not Good (NG) progressive image quality during the production. In addition, the time for the gamming tuning may be greatly adversely affected due to values of n and m in different driving IC architecture. When m has a large value to meet the requirement of the image quality, the time for all the above algorithm policies will be prolonged.

SUMMARY

In one aspect, the present disclosure provides in some embodiments an optical adjustment method for a display panel, including: displaying N groups of testing images sequentially on the display panel, each group of testing images including M images distributed at different display regions of the display panel, each image corresponding to one to-be-adjusted reference color, N being an integer greater than or equal to 1, M being an integer greater than or equal to 1; and when each group of testing images are displayed on the display panel, detecting, by an optical detection unit, optical parameters of the M images in the group of testing images simultaneously, and performing optical adjustment on the display panel in accordance with the optical parameters.

In a possible embodiment of the present disclosure, each image in each group of testing images corresponds to one to-be-adjusted reference grayscale binding point, and each optical parameter includes a brightness value and chromaticity coordinates. The performing the optical adjustment on the display panel in accordance with the optical parameters includes performing a gamma tuning operation on the display panel in accordance with the optical parameters, so as to enable a gamma value of each image to be a nominal gamma value.

In a possible embodiment of the present disclosure, the detecting, by the optical detection unit, the optical parameters of the M images in the group of testing images simultaneously includes, when the display region for each image in the M images is a strip-like region extending in a first direction, the M images are sequentially distributed in M columns in a second direction and the optical detection unit includes detection modules arranged in M columns corresponding to the M images respectively, detecting and processing, by the detection modules in each column, an average of the optical parameters of the images in a corresponding column as an optical parameter of the images in the corresponding column.

In a possible embodiment of the present disclosure, the detecting, by the optical detection unit, the optical parameters of the M images in the group of testing images simultaneously includes, when the display region for each image in the M images is a strip-like region extending in a second direction, the M images are sequentially distributed in M rows in a first direction and the optical detection unit includes detection modules arranged in M rows corresponding to the M images respectively, detecting and processing, by the detection modules in each row, an average of the optical parameters of the images in a corresponding row as an optical parameter of the images in the corresponding row.

In a possible embodiment of the present disclosure, the detecting, by the optical detection unit, the optical parameters of the M images in the group of testing images simultaneously includes, when the display region for each image in the M images is a block-like region, the M images are sequentially distributed in an array form in a first direction and a second direction perpendicular to the first direction, the optical detection unit includes M groups of detection modules corresponding to the M images respectively, and each group of detection modules include at least two detection modules, detecting and processing, by each group of detection modules, an average of the optical parameters of a corresponding image as an optical parameter of the corresponding image.

In a possible embodiment of the present disclosure, the detecting, by the optical detection unit, the optical parameters of the M images in the group of testing images simultaneously includes, when the display region for each image in the M images is a block-like region, the M images are sequentially distributed in an array form in a first direction and a second direction perpendicular to the first direction, the optical detection unit includes M groups of detection modules corresponding to the M images respectively, and each group of detection modules include one detection module, detecting and processing, by each detection module, the optical parameter of a corresponding image.

In a possible embodiment of the present disclosure, when the M images are arranges sequentially in M columns in the second direction, a coverage range of each image in the first direction extends through an active display region of the display panel.

In a possible embodiment of the present disclosure, when the M images are arranges sequentially in M rows in the first direction, a coverage range of each image in the second direction extends through the active display region of the display panel.

In a possible embodiment of the present disclosure, when the M images are arranges in an array form in the first direction and the second direction perpendicular to the first direction, the M images are distributed at a central region of the active display region of the display panel.

In a possible embodiment of the present disclosure, when the display region for each image of the M images is a strip-like region extending in the first direction and the M images are distributed sequentially in M columns in the second direction, the to-be-adjusted reference colors of the M images vary gradually in the second direction.

In a possible embodiment of the present disclosure, when the display region for each image of the M images is a strip-like region extending in the second direction and the M images are distributed sequentially in M rows in the first direction, the to-be-adjusted reference colors of the M images vary gradually in the first direction.

In another aspect, the present disclosure provides in some embodiments an optical adjustment device for a display panel, including: an image generation unit configured to display N groups of testing images sequentially on the display panel, each group of testing images including M images distributed at different display regions of the display panel, each image corresponding to one to-be-adjusted reference color, N being an integer greater than or equal to 1, M being an integer greater than or equal to 1; an optical detection unit configured to, when each group of testing images are displayed on the display panel, detect optical parameters of the M images in the group of testing images simultaneously; and an optical adjustment unit configured to perform optical adjustment on the display panel in accordance with the optical parameters.

In a possible embodiment of the present disclosure, each image in each group of testing images corresponds to one to-be-adjusted reference grayscale binding point, and each optical parameter includes a brightness value and chromaticity coordinates. The optical adjustment unit is further configured to perform a gamma tuning operation on the display panel in accordance with the optical parameters, so as to enable a gamma value of each image to be a nominal gamma value.

In a possible embodiment of the present disclosure, the image generation unit is further configured to control the display region for each image in the M images to be a strip-like region extending in a first direction, and control the M images to be sequentially distributed in M columns in a second direction. The optical detection unit includes detection modules arranged in M columns in the second direction, and the detection modules in each column are configured to detect and process the optical parameters of the images in a corresponding column.

In a possible embodiment of the present disclosure, the image generation unit is further configured to control the display region for each image in the M images to be a strip-like region extending in a second direction, and control the M images to be sequentially distributed in M rows in a first direction. The optical detection unit includes detection modules arranged in M rows in the first direction, and the detection modules in each row are configured to detect and process the optical parameters of the images in a corresponding row.

In a possible embodiment of the present disclosure, the image generation unit is further configured to control the display region for each image in the M images to be a block-like region, and control the M images to be sequentially distributed in an array form in a first direction and a second direction perpendicular to the first direction. The optical detection unit includes M groups of detection modules arranged in an array form in the first direction and the second direction, and each group of detection modules include at least two detection modules and are configured to detect and process the optical parameter of a corresponding image.

In a possible embodiment of the present disclosure, the image generation unit is further configured to control the display region for each image in the M images to be a block-like region, and control the M images to be sequentially distributed in an array form in a first direction and a second direction perpendicular to the first direction. The optical detection unit includes M groups of detection modules arranged in an array form in the first direction and the second direction, each group of detection modules include one detection module, and each detection module is configured to detect and process the optical parameter of a corresponding image.

In a possible embodiment of the present disclosure, the detection module includes: an optical probe configured to detect the optical parameter of each image; a photovoltaic conversion circuit configured to convert the optical parameter detected by the optical probe into an analogue electric signal; an electric signal amplification circuit configured to amplify the analogue electric signal; and an analogue-to-digital conversion circuit configured to convert the amplified analogue electric signal into a digital signal.

In yet another aspect, the present disclosure provides in some embodiments a display device including a display panel and the above-mentioned optical adjustment device.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

In the related art, it takes a long time for optical adjustment, e.g., a gamma tuning operation, on a display panel, so the manufacture efficiency may be adversely affected. An object of the present disclosure is to provide an optical adjustment method and an optical adjustment device for a display panel, and a display device, so as to reduce the time for the optical adjustment while ensuring the image quality, thereby to improve the manufacture efficiency.

The present disclosure provides in some embodiments an optical adjustment method, which includes: displaying N groups of testing images sequentially on a display panel, each group of testing images including M images distributed at different display regions of the display panel, each image corresponding to one to-be-adjusted reference color, N being an integer greater than or equal to 1, M being an integer greater than or equal to 1; and when each group of testing images are displayed on the display panel, detecting, by an optical detection unit, optical parameters of the M images in the group of testing images simultaneously, and performing optical adjustment on the display panel in accordance with the optical parameters.

Figure 1:
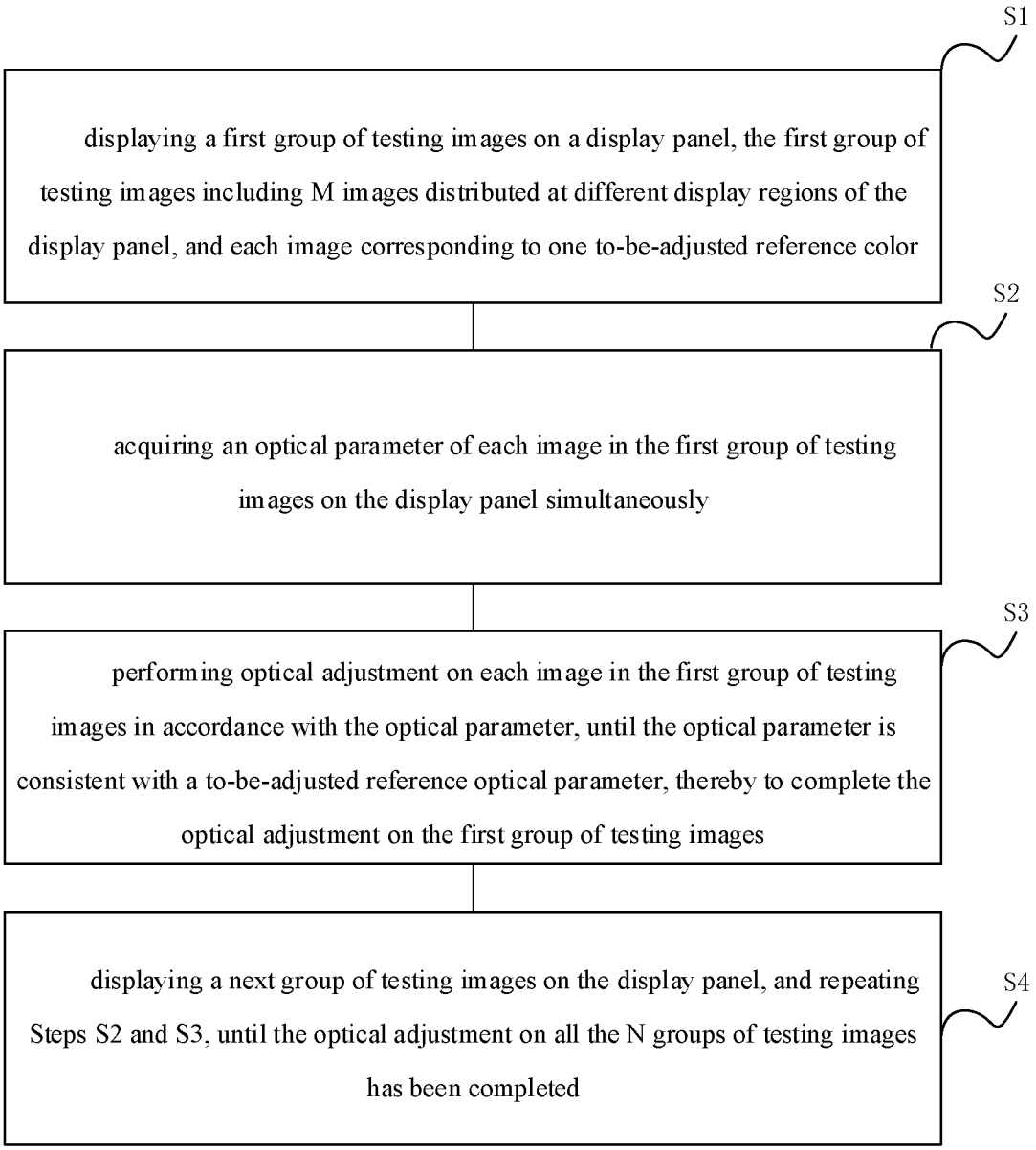
FIG. 1 is a flow chart of an optical adjustment method according to one embodiment of the present disclosure.

As shown in FIG. 1, the optical adjustment method for the display panel may include the following steps.

Step S1: displaying a first group of testing images on the display panel. The first group of testing images may include M images distributed at different display regions of the display panel, and each image may correspond to one to-be-adjusted reference color.

Step S2: acquiring the optical parameter of each image in the first group of testing images on the display panel simultaneously.

Step S3: performing the optical adjustment on each image in the first group of testing images in accordance with the optical parameter, until the optical parameter is consistent with a to-be-adjusted reference optical parameter. At this time, the optical adjustment on the first group of testing images has been completed.

Step S4: displaying a next group of testing images on the display panel, and repeating Steps S2 and S3, until the optical adjustment on all the N groups of testing images has been completed.

According to the optical adjustment method in the embodiments of the present disclosure, the N groups of testing images may be displayed sequentially on the display panel. When any group of testing image are being displayed, M images (which may be distributed in an array form) in the group of testing images may be displayed simultaneously at different display regions of the display panel, and each image may correspond to one to-be-adjusted reference color. Then, the optical parameters of the M images in the group of testing images may be acquired simultaneously, and the optical adjustment (e.g., gamma tuning) may be performed simultaneously on the M images in accordance with the acquired optical parameters. After the optical adjustment on one group of testing images has been performed, the optical adjustment on a next group of testing images may be performed, i.e., it is necessary to perform the optical adjustment on the testing images in N times. As compared with a serial adjustment mode in the related art, taking the gamma tuning as an example, in the embodiments of the present disclosure, it is able to reduce the quantity of debugging points from n*m to n*1, thereby to reduce the time for the gamma tuning while ensuring the image quality, and improve the manufacture efficiency.

It should be appreciated that, the optical adjustment method in the embodiments of the present disclosure may be applied to, but not limited to, gamma tuning. For example, it may also be applied to white balance adjustment.

The optical adjustment method will be described hereinafter in more details when it is applied to gamma tuning.

When the optical adjustment method is applied to the gamma tuning, N groups of testing images may be provided with respect to different target brightness values (gamma bands).

The N groups of testing images may be sequentially displayed on the display panel. Each group of testing images may include M images distributed at different display regions of the display panel. Each image may correspond to one to-be-adjusted reference color, i.e., each image in each group of testing images may correspond to one to-be-adjusted reference grayscale binding points.

For the optical parameters of the M images in the group of testing images detected simultaneously by the optical detection unit, each optical parameter may include a brightness value and chromaticity coordinates.

The performing the optical adjustment on the display panel in accordance with the optical parameters may include performing a gamma tuning operation on the display panel in accordance with the optical parameters, so as to enable a gamma value of each image to be a nominal gamma value.

Figure 2:
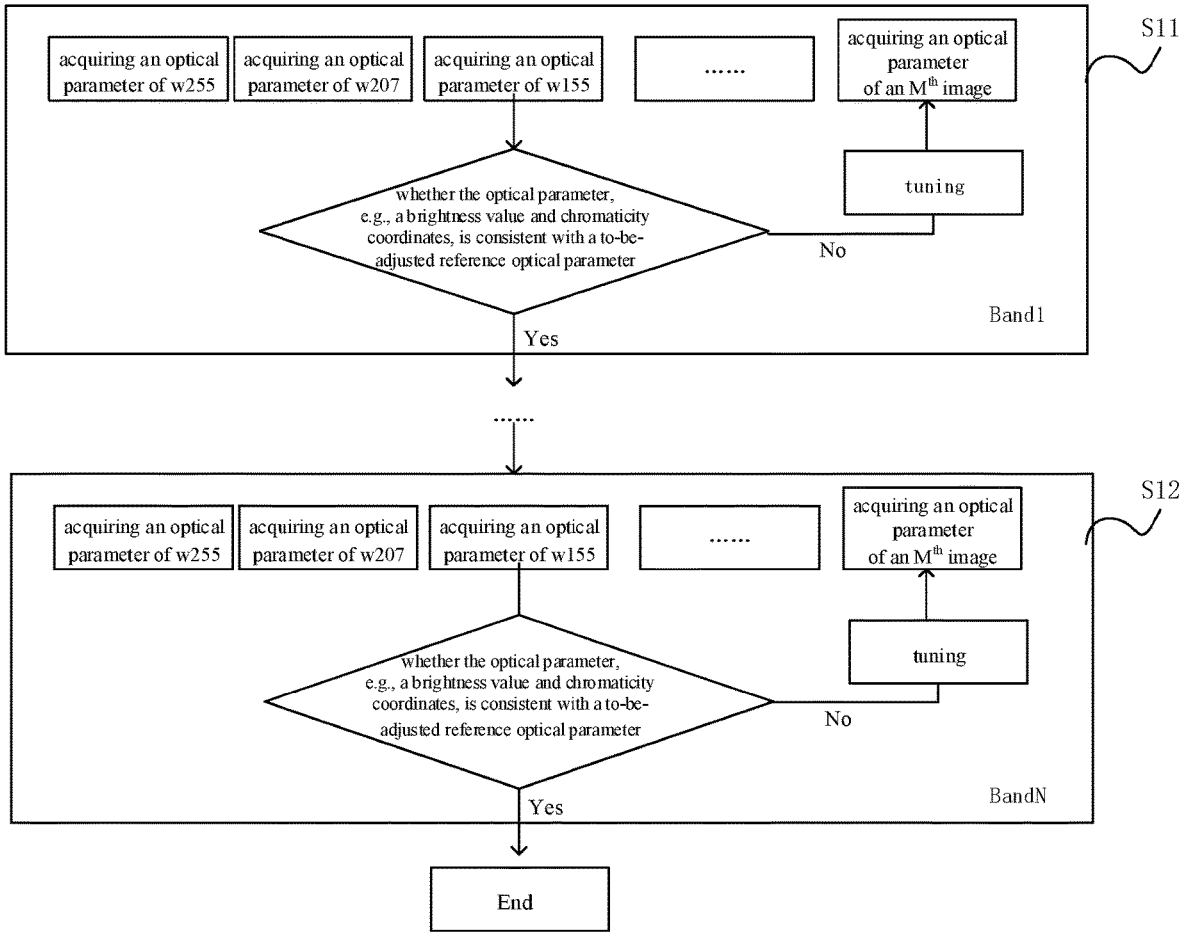
FIG. 2 is a schematic view showing the application of the optical adjustment method for gamma tuning according to one embodiment of the present disclosure.

For example, the M images may include 0, 3, 7, . . . , and 255 to-be-adjusted reference grayscale binding points respectively. During the gamma tuning operation, it is necessary to adjust the chromaticity coordinates and the brightness value of each grayscale binding point to the nominal gamma value. As shown in FIG. 2, a gamming tuning procedure may include the following steps.

Step S11: displaying a first group of testing images on the display panel, acquiring the optical parameters, e.g., the brightness values and the chromaticity coordinates, of the M images in the first group of testing images, and performing the gamma tuning operation on each image in the first group of testing images in accordance with the optical parameters, until the gamma value of each image in the first group of testing images has been adjusted to the nominal gamma value. At this time, the optical adjustment on the first group of testing images has been completed.

Step S12: displaying a next group of testing images on the display panel, acquiring the optical parameters, e.g., the brightness values and the chromaticity coordinates, of the M images in the next group of testing images, and performing the gamma tuning operation on each image in the first group of testing images in accordance with the optical parameters, until the gamma value of each image in the next group of testing images has been adjusted to the nominal gamma value. The above step may be repeated, until the gamma tuning operation on all the N groups of testing images has been performed.

During the above-mentioned tuning procedure, for each group of testing images (i.e., each gamma band), its tuning time T/T=MAX (TT_W255, TT_W207, . . . , TT_W0) (W represents a white image), i.e., a longest tuning time for a certain grayscale binding point may be acquired. In the conventional serial adjustment mode, for each gamma band, its running time T/T=TT_W255+TT_W207+ . . . +TT_W0) (W represents a white image), so the tuning time may be several times over that in the embodiments of the present disclosure. Obviously, through the optical adjustment method in the embodiments of the present disclosure, it is able to remarkably reduce the tuning time and improve the manufacture efficiency. In addition, in the embodiments of the present disclosure, the tuning operation may be performed with respect to different gamma bands, so it is able to perform characteristic matching in an exhaustive manner, thereby to ensure the image quality.

In addition, it should be appreciated that, for the optical adjustment method in the embodiments of the present disclosure, the optical parameters of the M images in each group of testing images may be detected simultaneously by the optical detection unit, and the optical detection unit may include M detection modules corresponding to the M images respectively. In a possible embodiment of the present disclosure, each detection module may include an optical probe configured to detect the optical parameter of each image, a photovoltaic conversion circuit configured to convert the optical parameter detected by the optical probe into an analogue electric signal, an electric signal amplification circuit configured to amplify the analogue electric signal, and an analogue-to-digital conversion circuit configured to convert the amplified analogue electric signal into a digital signal.

The M images in each group of testing images may be distributed in an array form, and correspondingly the optical probes may also be arranged in an array form.

Considering an IR drop characteristic and a Long Range Uniformity (LRU) brightness distribution characteristic of the display panel as well as a simplified design of the optical probes in the array form, several arrangement modes of the M images in each group of testing images and the corresponding arrangement modes (organization modes) of the optical probes will be illustratively described hereinafter.

Figure 3:
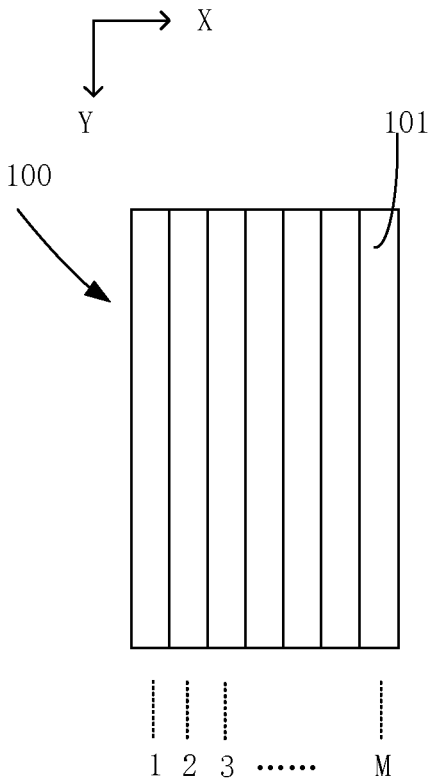
FIG. 3 is a schematic view showing the arrangement of testing images on a display panel according to one embodiment of the present disclosure.
Figure 4:
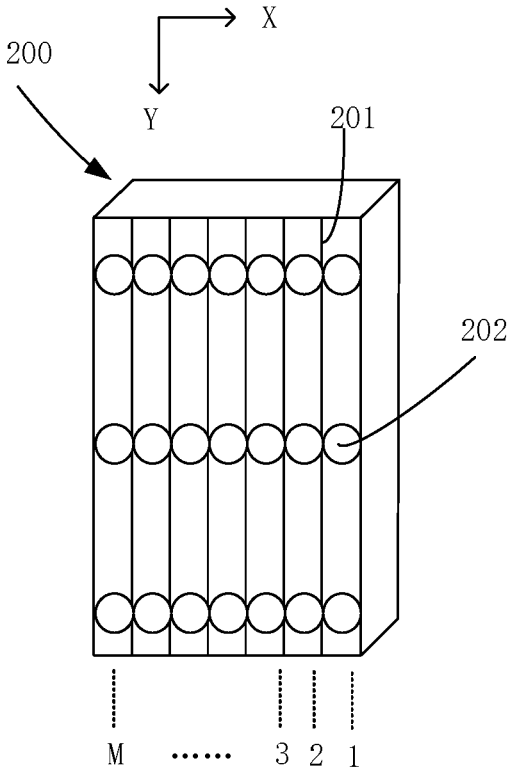
FIG. 4 is a schematic view showing the arrangement of testing modules of an optical detection unit according to one embodiment of the present disclosure.

In a possible embodiment of the present disclosure, as shown in FIGS. 3 and 4, the step of detecting, by the optical detection unit, the optical parameters of the M images in the group of testing images simultaneously may include, when the display region of the display panel 100 for each image 101 in the M images is a strip-like region extending in a first direction (i.e., Y direction), the M images are sequentially distributed in M columns in a second direction (i.e., X direction) and the optical detection unit 200 includes detection modules 201 arranged in M columns corresponding to the M images respectively, detecting and processing, by the detection modules 201 in each column, an average of the optical parameters of the images 101 in a corresponding column as an optical parameter of the images 101 in the corresponding column.

To be specific, as shown in FIGS. 3 and 4, in each group of testing images, the M images 101 may be distributed sequentially in the X direction. Because the display region for each image 101 is a strip-like region extending in the Y direction, the M images 101 may be distributed in M columns. The optical detection unit 200 needs to acquire the optical parameters of the M images 101 simultaneously, so it is necessary to separately provide a detection module 201 for each image 101. As shown in FIG. 4, the detection modules 201 of the optical detection unit 200 may be arranged in M columns. For the display panel, the optical parameters, e.g., the brightness values, at different regions in the Y direction may be different from each other, so when the display region for each image 101 is designed as a strip-like region extending in the Y direction, an average of optical quantities of the corresponding image 101 acquired by the detection modules 201 may be taken as an optical quantity of the image 101. In this way, it is able to prevent the adjustment from being adversely affected due to the difference in the optical parameters, e.g., the brightness values, at different regions of the display panel in the Y direction.

It should be appreciated that, as shown in FIG. 4, the detection modules 201 in each column may include at least two optical probes 202, so as to acquire the optional parameters of the images 101 in a corresponding column at different regions in the Y direction, thereby to take the average of the optical parameters of the images 101 in the corresponding column as the optical parameter of the images 101 in the corresponding column.

It should be further appreciated that, when the M images 101 are distributed sequentially in M columns in the second direction, a coverage range of each image 101 in the first direction may extend through an active display region of the display panel.

Based on the above, the optical adjustment method may be applied to a display panel where there is a relatively large difference in the optical parameters, e.g., the brightness values, at different regions, so as to prevent the adjustment from being adversely affected due to the difference.

It should be further appreciated that, the to-be-adjusted reference colors of the M images 101 in the second direction may vary gradually.

Taking the gamma tuning as an example, the to-be-adjusted reference grayscale binding points of the M images 101 may increase or decrease gradually in the second direction (i.e., the X direction).

It should be appreciated that, the to-be-adjusted reference color of each image 101 may be set in any other appropriate manner in accordance with the practical need.

Figure 5:
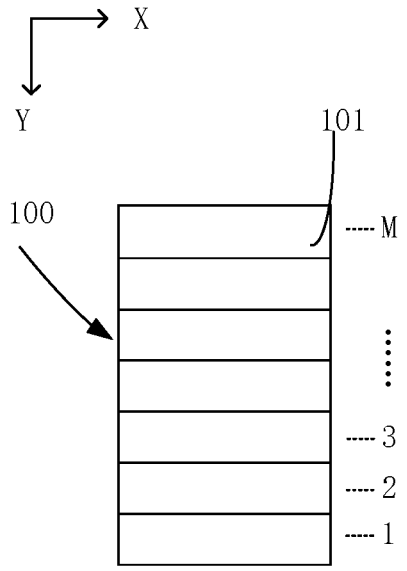
FIG. 5 is another schematic view showing the arrangement of the testing images on the display panel according to one embodiment of the present disclosure.
Figure 6:
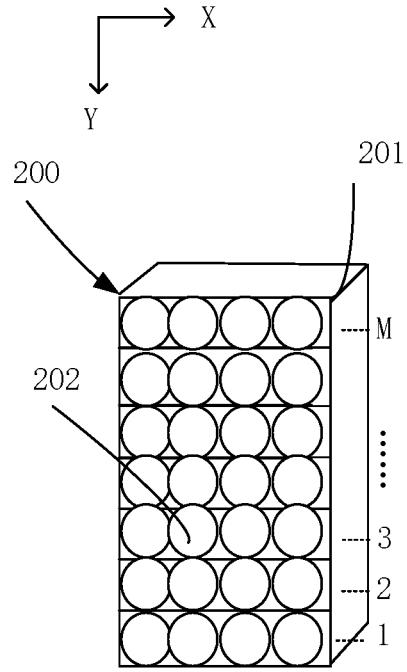
FIG. 6 is another schematic view showing the arrangement of the testing modules of the optical detection unit according to one embodiment of the present disclosure.

In another possible embodiment of the present disclosure, as shown in FIGS. 5 and 6, the step of detecting, by the optical detection unit 200, the optical parameters of the M images 101 in the group of testing images simultaneously may include, when the display region for each image 101 in the M images 101 is a strip-like region extending in a second direction (i.e., the X direction), the M images 101 are sequentially distributed in M rows in a first direction (i.e., the Y direction) and the optical detection unit 200 includes detection modules 291 arranged in M rows corresponding to the M images 101 respectively, detecting and processing, by the detection modules 201 in each row, an average of the optical parameters of the images 101 in a corresponding row as an optical parameter of the images 101 in the corresponding row.

To be specific, as shown in FIG. 5, in each group of testing images, the M images 101 may be distributed sequentially in the Y direction. Because the display region for each image 101 is a strip-like region extending in the X direction, the M images 101 may be distributed in M rows. The optical detection unit 200 needs to acquire the optical parameters of the M images 101 simultaneously, so it is necessary to separately provide a detection module 201 for each image 101. As shown in FIG. 6, the detection modules 201 of the optical detection unit 200 may be arranged in M rows. For the display panel, the optical parameters, e.g., the brightness values, at different regions in the Y direction may be different from each other, so when the display region for each image 101 is designed as a strip-like region extending in the X direction, an average of optical quantities of the corresponding images 101 acquired by the detection modules 201 may be taken as an optical quantity of the images 101. In this way, it is able to prevent the adjustment from being adversely affected due to the difference in the optical parameters, e.g., the brightness values, at different regions of the display panel in the X direction.

It should be appreciated that, as shown in FIG. 6, the detection modules 201 in each row may include at least two optical probes 202, so as to acquire the optional parameters of the images 101 in a corresponding row at different regions in the X direction, thereby to take the average value of the optical parameters of the images 101 in the corresponding row as the optical parameter of the images 101 in the corresponding row.

It should be further appreciated that, when the M images 101 are distributed sequentially in M rows in the first direction, a coverage range of each image 101 in the second direction may extend through the active display region of the display panel.

Based on the above, the optical adjustment method may be applied to a display panel where there is a relatively large difference in the optical parameters, e.g., the brightness values, at different regions, so as to prevent the adjustment from being adversely affected due to the difference.

It should be further appreciated that, the to-be-adjusted reference colors of the M images 101 in the first direction may vary gradually.

Taking the gamma tuning as an example, the to-be-adjusted reference color of the M images 101 may vary gradually incudes that the to-be-adjusted reference grayscale binding points of the M images 101 may increase or decrease gradually in the first direction (i.e., the Y direction).

It should be appreciated that, the to-be-adjusted reference color of each image 101 may be set in any other appropriate manner in accordance with the practical need.

Figure 7:
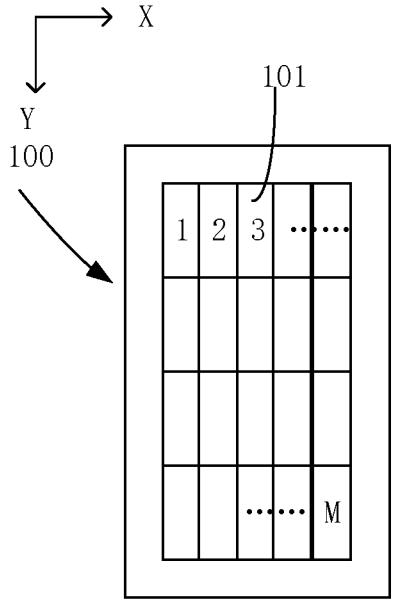
FIG. 7 is yet another schematic view showing the arrangement of the testing images on the display panel according to one embodiment of the present disclosure.
Figure 8:
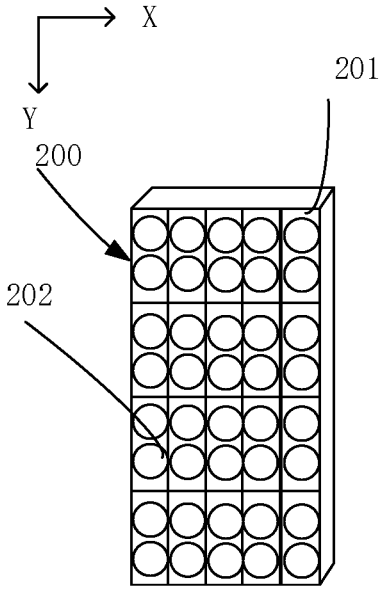
FIG. 8 is yet another schematic view showing the arrangement of the testing modules of the optical detection unit according to one embodiment of the present disclosure.

In yet another possible embodiment of the present disclosure, as shown in FIGS. 7 and 8, the step of detecting, by the optical detection unit 200, the optical parameters of the M images in the group of testing images simultaneously may include, when the display region for each image 101 in the M images 101 is a block-like region, the M images 101 are sequentially distributed in an array form in a first direction (i.e., the Y direction) and a second direction (i.e., the X direction) perpendicular to the first direction, the optical detection unit 200 includes M groups of detection modules 201 corresponding to the M images 101 respectively, and each group of detection modules 201 include at least two detection modules 201, detecting and processing, by each group of detection modules 201, an average value of the optical parameters of a corresponding image 101 as an optical parameter of the corresponding image 101.

To be specific, as shown in FIG. 7, in each group of testing images, the display region for each image 101 is a block-like region, and the M images 101 may be distributed in an array form in the Y direction and the X direction. The optical detection unit 200 needs to acquire the optical parameters of the M images 101 simultaneously, so it is necessary to separately provide a group of detection modules 201 for each image 101. As shown in FIG. 8, the groups of detection modules 201 of the optical detection unit 200 may be arranged in an array form correspondingly. When the display region for each image 101 has a relatively large area, the corresponding group of detection modules 201 may include at least two detection modules 201. In this way, each group of detection modules 201 may detect and process an average value of the optical parameters of the corresponding image 101 as the optical parameter of the image 101, so as to prevent the adjustment from being adversely affected due to the difference in the optical parameters, e.g., the brightness values, at different regions of the display panel in the Y direction.

It should be appreciated that, as shown in FIG. 7, the M images 101 may be distributed at a central region of the active display region of the display panel.

Based on the above, the optical adjustment method may be applied to a display panel where there is a relatively small difference in the optical parameters, e.g., the brightness values, at a central display region and a peripheral display region, so as to merely perform the optical adjustment at the central region of the active display region of the display panel in accordance with the practical need. It should be appreciated that, in actual use, the M images 101 may also be distributed at the entire active display region of the display panel.

It should be further appreciated that, the to-be-adjusted reference colors of the images 101 in each row may vary gradually in the first direction, and the to-be-adjusted reference colors of the images 101 in each column may vary gradually in the second direction.

Taking the gamma tuning as an example, the to-be-adjusted reference grayscale binding points of the images 101 in each row may increase or decrease gradually in the first direction (i.e., the Y direction), and the to-be-adjusted reference grayscale binding points of the images 101 in each column may increase or decrease gradually in the second direction (i.e., the X direction).

It should be appreciated that, the to-be-adjusted reference color of each image 101 may be set in any other appropriate manner in accordance with the practical need.

Figure 9:
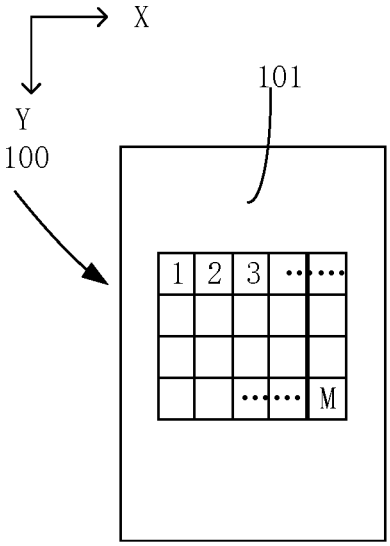
FIG. 9 is still yet another schematic view showing the arrangement of the testing images on the display panel according to one embodiment of the present disclosure.
Figure 10:
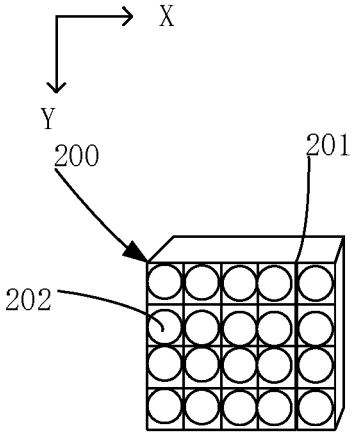
FIG. 10 is still yet another schematic view showing the arrangement of the testing modules of the optical detection unit according to one embodiment of the present disclosure.

In still yet another possible embodiment of the present disclosure, as shown in FIGS. 9 and 10, the step of detecting, by the optical detection unit, the optical parameters of the M images in the group of testing images simultaneously may include, when the display region for each image 101 in the M images 101 is a block-like region, the M images 101 are sequentially distributed in an array form in a first direction (i.e., the Y direction) and a second direction (i.e., the X direction) perpendicular to the first direction, the optical detection unit 200 includes M groups of detection modules 201 corresponding to the M images 101 respectively, and each group of detection modules 201 include one detection module 201, detecting and processing, by each detection module 201, the optical parameter of a corresponding image 101.

To be specific, as shown in FIG. 9, in each group of testing images, the display region for each image 101 is a block-like region, and the M images 101 may be distributed in an array form in the Y direction and the X direction. The optical detection unit 200 needs to acquire the optical parameters of the M images 101 simultaneously, so when the display region for each image 101 has a relatively small area, it is necessary to separately provide a detection module 201 for each image 101. As shown in FIG. 10, the detection modules 201 may be arranged in an array form. In this way, each detection module 201 may detect and process the optical parameter of the corresponding image 101.

It should be appreciated that, as shown in FIG. 9, the M images 101 may be distributed at a central region of the active display region of the display panel.

Based on the above, the optical adjustment method may be applied to a display panel where there is a relatively small difference in the optical parameters, e.g., the brightness values, at a central display region and a peripheral display region, so as to merely perform the optical adjustment at the central region of the active display region of the display panel in accordance with the practical need. It should be appreciated that, in actual use, the M images 101 may also be distributed at the entire active display region of the display panel.

It should be further appreciated that, the to-be-adjusted reference colors of the images 101 in each row may vary gradually in the first direction, and the to-be-adjusted reference colors of the images 101 in each column may vary gradually in the second direction.

Taking the gamma tuning as an example, the to-be-adjusted reference grayscale binding points of the images 101 in each row may increase or decrease gradually in the first direction (i.e., the Y direction), and the to-be-adjusted reference grayscale binding points of the images 101 in each column may increase or decrease gradually in the second direction (i.e., the X direction).

It should be appreciated that, the to-be-adjusted reference color of each image 101 may be set in any other appropriate manner in accordance with the practical need.

The above embodiments are provided for illustrative purses only, and in actual use, the optical adjustment may be performed in different ways with respect to different requirements of the display products. It should be appreciated that, the optical adjustment method may not be limited to the above embodiments.

Figure 11:
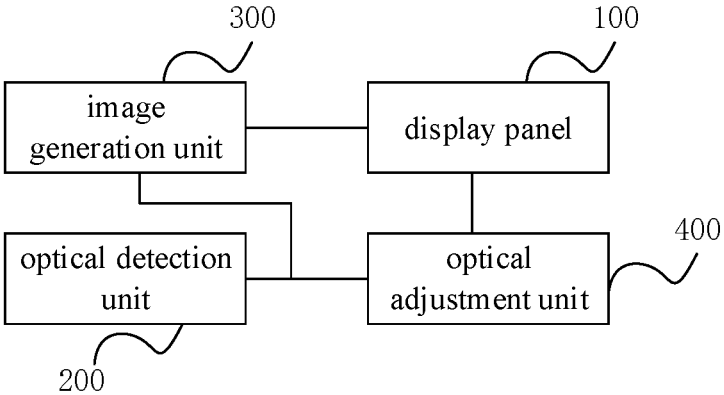
FIG. 11 is a schematic view showing an optical adjustment device according to one embodiment of the present disclosure.

The present disclosure further provides in some embodiments an optical adjustment device for a display panel. As shown in FIG. 11, the optical adjustment device includes: an image generation unit 300 configured to display N groups of testing images sequentially on the display panel 100, each group of testing images including M images 101 distributed at different display regions of the display panel 100, each image 101 corresponding to one to-be-adjusted reference color, N being an integer greater than or equal to 1, M being an integer greater than or equal to 1; an optical detection unit 200 configured to, when each group of testing images are displayed on the display panel 100, detect optical parameters of the M images 101 in the group of testing images simultaneously; and an optical adjustment unit 400 configured to perform optical adjustment on the display panel in accordance with the optical parameters.

According to the optical adjustment device in the embodiments of the present disclosure, the image generation unit 300 may display the N groups of testing images sequentially on the display panel. When any group of testing image are being displayed, the M images 101 (which may be distributed in an array form) in the group of testing images may be displayed simultaneously at different display regions of the display panel, and each image 101 may correspond to one to-be-adjusted reference color. Then, the optical detection unit 200 may acquire the optical parameters of the M images 101 in the group of testing images simultaneously, and the optical adjustment unit 400 may perform the optical adjustment (e.g., gamma tuning) simultaneously on the M images in accordance with the acquired optical parameters. After the optical adjustment on one group of testing images has been performed, the image generation unit 300 may display a next group of testing images on the display panel, so as to perform the optical adjustment on the next group of testing images, i.e., it is necessary to perform the optical adjustment on the testing images in N times. As compared with a serial adjustment mode in the related art, taking the gamma tuning as an example, in the embodiments of the present disclosure, it is able to reduce the quantity of debugging points from n*m to n*1, thereby to reduce the time for the gamma tuning while ensuring the image quality, and improve the manufacture efficiency.

It should be appreciated that, the optical adjustment device in the embodiments of the present disclosure may be adopted to, but not limited to, perform gamma tuning. For example, it may also be adopted to perform white balance adjustment.

The optical adjustment device will be described hereinafter in more details when it is adopted to perform gamma tuning.

When the optical adjustment device is adopted to perform the gamma tuning, the image generation unit 300 may display N groups of testing images on the display panel with respect to different target brightness values (gamma bands).

The image generation unit 300 may display N groups of testing images sequentially on the display panel. Each group of testing images may include M images 101 distributed at different display regions of the display panel. Each image 101 may correspond to one to-be-adjusted reference color, i.e., each image 101 in each group of testing images may correspond to one to-be-adjusted reference grayscale binding points.

The optical detection unit 200 is further configured to detect the optical parameters of the M images 101 in the group of testing images simultaneously, and each optical parameter may include a brightness value and chromaticity coordinates.

The optical adjustment unit 400 is further configured to perform a gamma tuning operation on the display panel in accordance with the optical parameters, so as to enable a gamma value of each image 101 to be a nominal gamma value.

For example, the M images 101 may include 0, 3, 7, . . . , and 255 to-be-adjusted reference grayscale binding points respectively. During the gamma tuning operation, it is necessary to adjust the chromaticity coordinates and the brightness value of each grayscale binding point to the nominal gamma value. A gamming tuning procedure performed by the optical adjustment device may include the following steps.

Step S11: displaying a first group of testing images on the display panel, acquiring the optical parameters, e.g., the brightness values and the chromaticity coordinates, of the M images 101 in the first group of testing images, and performing the gamma tuning operation on each image 101 in the first group of testing images in accordance with the optical parameters, until the gamma value of each image 101 in the first group of testing images has been adjusted to the nominal gamma value. At this time, the optical adjustment on the first group of testing images has been completed.

Step S12: displaying a next group of testing images on the display panel, acquiring the optical parameters, e.g., the brightness values and the chromaticity coordinates, of the M images 101 in the next group of testing images, and performing the gamma tuning operation on each image 101 in the next group of testing images in accordance with the optical parameters, until the gamma value of each image 101 in the next group of testing images has been adjusted to the nominal gamma value. The above step may be repeated, until the gamma tuning operation on all the N groups of testing images has been performed.

During the above-mentioned tuning procedure, for each group of testing images (i.e., each gamma band), its tuning time T/T=MAX (TT_W255, TT_W207, . . . , TT_W0) (W represents a white image), i.e., a longest tuning time for a certain grayscale binding point may be acquired. In the conventional serial adjustment mode, for each gamma band, its running time T/T=TT_W255+TT_W207+ . . . +TT_W0) (W represents a white image), so the tuning time may be several times over that in the embodiments of the present disclosure. Obviously, through the optical adjustment device in the embodiments of the present disclosure, it is able to remarkably reduce the tuning time and improve the manufacture efficiency. In addition, in the embodiments of the present disclosure, the tuning operation may be performed with respect to different gamma bands, so it is able to perform characteristic matching in an exhaustive manner, thereby to ensure the image quality.

In addition, it should be appreciated that, for the optical adjustment device in the embodiments of the present disclosure, the optical parameters of the M images 101 in each group of testing images may be detected simultaneously by the optical detection unit 200, and the optical detection unit 200 may include M detection modules 201 corresponding to the M images 101 respectively. In a possible embodiment of the present disclosure, each detection module 201 may include an optical probe configured to detect the optical parameter of each image 101, a photovoltaic conversion circuit configured to convert the optical parameter detected by the optical probe into an analogue electric signal, an electric signal amplification circuit configured to amplify the analogue electric signal, and an analogue-to-digital conversion circuit configured to convert the amplified analogue electric signal into a digital signal.

The M images 101 in each group of testing images may be distributed in an array form, and correspondingly the optical probes may also be arranged in an array form.

Considering an IR drop characteristic and an LRU brightness distribution characteristic of the display panel as well as a simplified design of the optical probes in the array form, several arrangement modes of the M images 101 in each group of testing images and the corresponding arrangement modes (organization modes) of the optical probes will be illustratively described hereinafter.

In a possible embodiment of the present disclosure, as shown in FIGS. 3 and 4, the image generation unit 300 is further configured to control the display region for each image 101 in the M images 101 to be a strip-like region extending in a first direction (i.e., a Y direction), and control the M images 101 to be sequentially distributed in M columns in a second direction (i.e., an X direction). The optical detection unit 200 may include detection modules 201 arranged in M columns corresponding to the M images 101 respectively, and the detection modules 201 in each column are configured to detect and process an average value of the optical parameters of the images in a corresponding column as the optical parameter of the images 101 in the corresponding column.

To be specific, as shown in FIG. 3, in each group of testing images, the M images 101 may be distributed sequentially in the X direction. Because the display region for each image 101 is a strip-like region extending in the Y direction, the M images 101 may be distributed in M columns. The optical detection unit 200 needs to acquire the optical parameters of the M images 101 simultaneously, so it is necessary to separately provide a detection module 201 for each image 101. As shown in FIG. 4, the detection modules 201 of the optical detection unit 200 may be arranged in M columns. For the display panel, the optical parameters, e.g., the brightness values, at different regions in the Y direction may be different from each other, so when the display region for each image 101 is designed as a strip-like region extending in the Y direction, an average value of optical quantities of the corresponding image 101 acquired by the detection modules 201 may be taken as an optical quantity of the image 101. In this way, it is able to prevent the adjustment from being adversely affected due to the difference in the optical parameters, e.g., the brightness values, at different regions of the display panel in the Y direction.

It should be appreciated that, as shown in FIG. 4, the detection modules 201 in each column may include at least two optical probes 202, so as to acquire the optional parameters of the images 101 in a corresponding column at different regions in the Y direction, thereby to take the average value of the optical parameters of the images 101 in the corresponding column as the optical parameter of the images 101 in the corresponding column.

It should be further appreciated that, when the M images 101 are distributed sequentially in M columns in the second direction, a coverage range of each image 101 in the first direction may extend through an active display region of the display panel.

Based on the above, the optical adjustment device may be applied to a display panel where there is a relatively large difference in the optical parameters, e.g., the brightness values, at different regions, so as to prevent the adjustment from being adversely affected due to the difference.

It should be further appreciated that, the to-be-adjusted reference colors of the M images 101 in the second direction may vary gradually.

Taking the gamma tuning as an example, the to-be-adjusted reference colors of the M images 101 in the second direction varying gradually includes that the to-be-adjusted reference grayscale binding points of the M images 101 may increase or decrease gradually in the second direction (i.e., the X direction).

It should be appreciated that, the to-be-adjusted reference color of each image 101 may be set in any other appropriate manner in accordance with the practical need.

In another possible embodiment of the present disclosure, as shown in FIGS. 5 and 6, the image generation unit 300 is further configured to control the display region for each image 101 in the M images 101 to be a strip-like region extending in a second direction (i.e., the X direction), and control the M images 101 to be sequentially distributed in M rows in a first direction (i.e., the Y direction). The optical detection unit 200 may include detection modules 201 arranged in M rows corresponding to the M images 101 respectively, and the detection modules 201 in each row are configured to detect and process an average value of the optical parameters of the images 101 in a corresponding row as the optical parameter of the images 101 in the corresponding row.

To be specific, as shown in FIG. 5, in each group of testing images, the M images 101 may be distributed sequentially in the Y direction. Because the display region for each image 101 is a strip-like region extending in the X direction, the M images 101 may be distributed in M rows. The optical detection unit 200 needs to acquire the optical parameters of the M images 101 simultaneously, so it is necessary to separately provide a detection module 201 for each image 101. As shown in FIG. 6, the detection modules 201 of the optical detection unit 200 may be arranged in M rows. For the display panel, the optical parameters, e.g., the brightness values, at different regions in the Y direction may be different from each other, so when the display region for each image 101 is designed as a strip-like region extending in the X direction, an average value of optical quantities of the corresponding images 101 acquired by the detection modules 201 may be taken as an optical quantity of the images 101. In this way, it is able to prevent the adjustment from being adversely affected due to the difference in the optical parameters, e.g., the brightness values, at different regions of the display panel in the X direction.

It should be appreciated that, as shown in FIG. 6, the detection modules 201 in each row may include at least two optical probes 202, so as to acquire the optional parameters of the images 101 in a corresponding row at different regions in the X direction, thereby to take the average value of the optical parameters of the images 101 in the corresponding row as the optical parameter of the images 101 in the corresponding row.

It should be further appreciated that, when the M images 101 are distributed sequentially in M rows in the first direction, a coverage range of each image 101 in the second direction may extend through the active display region of the display panel.

Based on the above, the optical adjustment device may be applied to a display panel where there is a relatively large difference in the optical parameters, e.g., the brightness values, at different regions, so as to prevent the adjustment from being adversely affected due to the difference.

It should be further appreciated that, the to-be-adjusted reference colors of the M images 101 in the first direction may vary gradually.

Taking the gamma tuning as an example, the to-be-adjusted reference colors of the M images 101 in the first direction varying gradually includes that the to-be-adjusted reference grayscale binding points of the M images 101 may increase or decrease gradually in the first direction (i.e., the Y direction).

It should be appreciated that, the to-be-adjusted reference color of each image 101 may be set in any other appropriate manner in accordance with the practical need.

In yet another possible embodiment of the present disclosure, as shown in FIGS. 7 and 8, the image generation unit 300 is further configured to control the display region for each image 101 in the M images 101 to be a block-like region, and control the M images 101 to be sequentially distributed in an array form in a first direction (i.e., the Y direction) and a second direction (i.e., the X direction) perpendicular to the first direction. The optical detection unit 200 may include M groups of detection modules 201 corresponding to the M images 101 respectively, and each group of detection modules 201 may include at least two detection modules 201 and are configured to detect and process an average value of the optical parameters of a corresponding image 101 as the optical parameter of the corresponding image 101.

To be specific, as shown in FIG. 7, in each group of testing images, the display region for each image 101 is a block-like region, and the M images 101 may be distributed in an array form in the Y direction and the X direction. The optical detection unit 200 needs to acquire the optical parameters of the M images 101 simultaneously, so it is necessary to separately provide a group of detection modules 201 for each image 101. As shown in FIG. 8, the groups of detection modules 201 of the optical detection unit 200 may be arranged in an array form correspondingly. When the display region for each image 101 has a relatively large area, the corresponding group of detection modules 201 may include at least two detection modules 201. In this way, each group of detection modules 201 may detect and process an average value of the optical parameters of the corresponding image 101 as the optical parameter of the image 101, so as to prevent the adjustment from being adversely affected due to the difference in the optical parameters, e.g., the brightness values, at different regions of the display panel.

It should be appreciated that, as shown in FIG. 7, the M images 101 may be distributed at a central region of the active display region of the display panel.

Based on the above, the optical adjustment method may be applied to a display panel where there is a relatively small difference in the optical parameters, e.g., the brightness values, at a central display region and a peripheral display region, so as to merely perform the optical adjustment at the central region of the active display region of the display panel in accordance with the practical need. It should be appreciated that, in actual use, the M images 101 may also be distributed at the entire active display region of the display panel.

It should be further appreciated that, the to-be-adjusted reference colors of the images 101 in each row may vary gradually in the first direction, and the to-be-adjusted reference colors of the images 101 in each column may vary gradually in the second direction.

Taking the gamma tuning as an example, the to-be-adjusted reference grayscale binding points of the images 101 in each row may increase or decrease gradually in the first direction (i.e., the Y direction), and the to-be-adjusted reference grayscale binding points of the images 101 in each column may increase or decrease gradually in the second direction (i.e., the X direction).

It should be appreciated that, the to-be-adjusted reference color of each image 101 may be set in any other appropriate manner in accordance with the practical need.

In still yet another possible embodiment of the present disclosure, as shown in FIGS. 9 and 10, the image generation unit 300 is further configured to control the display region for each image 101 in the M images 101 to be a block-like region, and control the M images 101 to be sequentially distributed in an array form in a first direction (i.e., the Y direction) and a second direction (i.e., the X direction) perpendicular to the first direction. The optical detection unit 200 may include M groups of detection modules 201 corresponding to the M images 101 respectively, each group of detection modules 201 may include one detection module 201, and each detection module 201 is configured to detect and process the optical parameter of a corresponding image 101.

To be specific, as shown in FIG. 9, in each group of testing images, the display region for each image 101 is a block-like region, and the M images 101 may be distributed in an array form in the Y direction and the X direction. The optical detection unit 200 needs to acquire the optical parameters of the M images 101 simultaneously, so when the display region for each image 101 has a relatively small area, it is necessary to separately provide a detection module 201 for each image 101. As shown in FIG. 10, the detection modules 201 may be arranged in an array form. In this way, each detection module 201 may detect and process the optical parameter of the corresponding image 101.

It should be appreciated that, as shown in FIG. 9, the M images 101 may be distributed at a central region of the active display region of the display panel.

Based on the above, the optical adjustment method may be applied to a display panel where there is a relatively small difference in the optical parameters, e.g., the brightness values, at a central display region and a peripheral display region, so as to merely perform the optical adjustment at the central region of the active display region of the display panel in accordance with the practical need. It should be appreciated that, in actual use, the M images 101 may also be distributed at the entire active display region of the display panel.

It should be further appreciated that, the to-be-adjusted reference colors of the images 101 in each row may vary gradually in the first direction, and the to-be-adjusted reference colors of the images 101 in each column may vary gradually in the second direction.

Taking the gamma tuning as an example, the to-be-adjusted reference grayscale binding points of the images 101 in each row may increase or decrease gradually in the first direction (i.e., the Y direction), and the to-be-adjusted reference grayscale binding points of the images 101 in each column may increase or decrease gradually in the second direction (i.e., the X direction).

It should be appreciated that, the to-be-adjusted reference color of each image 101 may be set in any other appropriate manner in accordance with the practical need.

The above embodiments are provided for illustrative purses only, and in actual use, the optical adjustment may be performed in different ways with respect to different requirements of the display products. It should be appreciated that, the optical adjustment device may not be limited to the above embodiments.

The present disclosure further provides in some embodiments a display device including a display panel and the above-mentioned optical adjustment device.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. An optical adjustment method for a display panel, comprising:

displaying N groups of testing images sequentially on the display panel, each group of testing images comprising M images distributed at different display regions of the display panel, each image corresponding to one to-be-adjusted reference color, N being an integer greater than or equal to 1, M being an integer greater than or equal to 1; and when each group of testing images are displayed on the display panel, detecting, by an optical detection unit, optical parameters of the M images in the group of testing images simultaneously, and performing optical adjustment on the display panel in accordance with the optical parameters, wherein each image in each group of testing images corresponds to one to-be-adjusted reference grayscale binding point, and the optical parameters comprise a brightness value and chromaticity coordinates, wherein the performing the optical adjustment on the display panel in accordance with the optical parameters comprises:

performing a gamma tuning operation on the display panel in accordance with the optical parameters, so as to enable a gamma value of each image to be a nominal gamma value, and reduce the time for the optical adjustment while ensuring the image quality and improve the manufacture efficiency, wherein the detecting, by the optical detection unit, the optical parameters of the M images in the group of testing images simultaneously comprises:

when the display region for each image in the M images is a strip-like region extending in a first direction, the M images are sequentially distributed in M columns in a second direction, the to-be-adjusted reference colors of the M images vary gradually in the second direction, the optical detection unit comprises detection modules arranged in M columns corresponding to the M images respectively, detecting and processing, by the detection modules in each column, an average value of the optical parameters of the images in a corresponding column as an optical parameter of the images in the corresponding column, each detection module includes at least two optical probes, to acquire the optional parameters of the images in the corresponding column at different regions in the first direction; or when the display region for each image in the M images is a strip-like region extending in a second direction, the M images are sequentially distributed in M rows in a first direction, the to-be-adjusted reference colors of the M images vary gradually in the first direction, the optical detection unit comprises detection modules arranged in M rows corresponding to the M images respectively, detecting and processing, by the detection modules in each row, an average value of the optical parameters of the images in a corresponding row as an optical parameter of the images in the corresponding row, each detection module includes at least two optical probes, to acquire the optional parameters of the images in the corresponding row at different regions in the second direction.

2. The optical adjustment method according to claim 1, wherein when the M images are arranges sequentially in M columns in the second direction, the display region for each image in the first direction extends through an active display region of the display panel.

3. The optical adjustment method according to claim 1, wherein when the M images are arranges sequentially in M rows in the first direction, the display region for each image in the second direction extends through the active display region of the display panel.

4. The optical adjustment method according to claim 1, wherein when the M images are arranges in an array form in the first direction and the second direction perpendicular to the first direction, the M images are distributed at a central region of the active display region of the display panel.

5. An optical adjustment device for a display panel, comprising:

an image generation circuit configured to display N groups of testing images sequentially on the display panel, each group of testing images comprising M images distributed at different display regions of the display panel, each image corresponding to one to-be-adjusted reference color, N being an integer greater than or equal to 1, M being an integer greater than or equal to 1;

an optical detection unit configured to, when each group of testing images are displayed on the display panel, detect optical parameters of the M images in the group of testing images simultaneously; and an optical adjustment circuit configured to perform optical adjustment on the display panel in accordance with the optical parameters, wherein each image in each group of testing images corresponds to one to-be-adjusted reference grayscale binding point, and the optical parameters comprise a brightness value and chromaticity coordinates, wherein the optical adjustment circuit is further configured to perform a gamma tuning operation on the display panel in accordance with the optical parameters, so as to enable a gamma value of each image to be a nominal gamma value, and reduce the time for the optical adjustment while ensuring the image quality and improve the manufacture efficiency, wherein the image generation circuit is further configured to control the display region for each image in the M images to be a strip-like region extending in a first direction, and control the M images to be sequentially distributed in M columns in a second direction; the to-be-adjusted reference colors of the M images vary gradually in the second direction, the optical detection unit comprises detection modules arranged in M columns in the second direction; and the detection modules in each column are configured to detect and process the optical parameters of the images in a corresponding column, each detection module includes at least two optical probes, to acquire the optional parameters of the images in the corresponding column at different regions in the first direction; or wherein the image generation circuit is further configured to control the display region for each image in the M images to be a strip-like region extending in a second direction, and control the M images to be sequentially distributed in M rows in a first direction; the to-be-adjusted reference colors of the M images vary gradually in the first direction, the optical detection unit comprises detection modules arranged in M rows in the first direction; and the detection modules in each row are configured to detect and process the optical parameters of the images in a corresponding row, each detection module includes at least two optical probes, to acquire the optional parameters of the images in the corresponding row at different regions in the second direction.

6. The optical adjustment device according to claim 5, wherein the detection module comprises:

an optical probe configured to detect the optical parameter of each image;

a photovoltaic conversion circuit configured to convert the optical parameter detected by the optical probe into an analogue electric signal;

an electric signal amplification circuit configured to amplify the analogue electric signal; and an analogue-to-digital conversion circuit configured to convert the amplified analogue electric signal into a digital signal.

7. A display device, comprising a display panel and the optical adjustment device according to claim 5.

* * * * *